US010799877B2

(12) United States Patent
Ward

(10) Patent No.: US 10,799,877 B2
(45) Date of Patent: Oct. 13, 2020

(54) PAPER SHREDDER SUPPORT ASSEMBLY

(71) Applicant: John Ward, Cary, NC (US)

(72) Inventor: John Ward, Cary, NC (US)

( * ) Notice: Subject to any disclaimer, the term of this patent is extended or adjusted under 35 U.S.C. 154(b) by 252 days.

(21) Appl. No.: 15/961,118

(22) Filed: Apr. 24, 2018

(65) Prior Publication Data

US 2019/0321830 A1 Oct. 24, 2019

(51) Int. Cl.

| | |
|---|---|
| ***B02C 18/00*** | (2006.01) |
| ***B02C 21/02*** | (2006.01) |
| ***H01R 13/73*** | (2006.01) |
| ***H01R 27/02*** | (2006.01) |
| *H01R 13/66* | (2006.01) |

(52) U.S. Cl.

CPC ..... *B02C 18/0007* (2013.01); *B02C 21/02* (2013.01); *H01R 13/73* (2013.01); *H01R 27/02* (2013.01); *B02C 2018/0046* (2013.01); *H01R 13/665* (2013.01)

(58) Field of Classification Search

CPC ..... B02C 21/02; B02C 18/0007
USPC ..... 241/236, 100, 285.2, 286
See application file for complete search history.

(56) References Cited

U.S. PATENT DOCUMENTS 2,692,734 A * 10/1954 Brickley ..... B02C 1/14 241/274
4,143,823 A * 3/1979 Judson, Jr. ..... B02C 13/2804 241/100
5,020,733 A 6/1991 Strohmeyer
5,269,473 A 12/1993 Strohmeyer
5,312,054 A * 5/1994 Feer ..... A47J 43/25 241/273.2
5,871,162 A * 2/1999 Rajewski ..... B02C 13/04 241/100
7,104,481 B2 9/2006 Schenker
7,360,731 B2 4/2008 Easton
7,503,516 B2 * 3/2009 Chen ..... B02C 18/0007 241/100
7,721,982 B2 * 5/2010 Schwelling ..... B02C 18/2283 241/100
7,832,666 B2 * 11/2010 Montgomery ..... B02C 19/0075 241/27
7,878,436 B2 2/2011 Wang
8,028,940 B2 * 10/2011 Kelly ..... B02C 1/02 241/100
8,070,082 B2 12/2011 Sued et al.
8,074,912 B2 * 12/2011 Chang ..... B02C 18/0007 241/100
8,079,537 B2 * 12/2011 Chen ..... B02C 18/0007 241/100
8,393,559 B2 * 3/2013 Chen ..... B02C 18/0007 241/100
D728,010 S 4/2015 Xu
(Continued)

*Primary Examiner* — Faye Francis

(57) ABSTRACT

A paper shredder support assembly for positioning a shredder above a receptacle includes a plate. A plurality of tubes is coupled to and extends from a bottom of the plate. Each tube comprises a plurality of nested sections so that the tube is selectively extensible. The plurality of tubes is positioned to support the plate over a receptacle. An opening is positioned in the plate. A shredder is positioned in the opening and is coupled to the plate. The shredder is configured to shred items that are inserted into the shredder so that shredded waste is expelled into the receptacle. A panel is selectively couplable to the plate to cover the opening.

18 Claims, 5 Drawing Sheets

(56) References Cited

U.S. PATENT DOCUMENTS

| | | | | |
|---|---|---|---|---|
| 2004/0164192 | A1* | 8/2004 | Chang | B02C 18/0007 241/100 |
| 2005/0029375 | A1* | 2/2005 | Ho | B02C 18/0007 241/100 |
| 2005/0167535 | A1* | 8/2005 | Rajewski | B02C 18/0007 241/100 |
| 2006/0283994 | A1* | 12/2006 | Webb | A47J 43/25 341/95 |
| 2007/0018020 | A1* | 1/2007 | Wang | B02C 18/0007 241/100 |
| 2007/0034723 | A1* | 2/2007 | Joachim | B02C 18/0007 241/100 |
| 2009/0212145 | A1* | 8/2009 | Huang | B02C 18/0007 241/285.2 |

* cited by examiner

PAPER SHREDDER SUPPORT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to support assemblies and more particularly pertains to a new support assembly for positioning a shredder above a receptacle.

BRIEF SUMMARY OF THE INVENTION

An embodiment of the disclosure meets the needs presented above by generally comprising a plate. A plurality of tubes is coupled to and extends from a bottom of the plate. Each tube comprises a plurality of nested sections so that the tube is selectively extensible. The plurality of tubes is positioned to support the plate over a receptacle. An opening is positioned in the plate. A shredder is positioned in the opening and is coupled to the plate. The shredder is configured to shred items that are inserted into the shredder so that shredded waste is expelled into the receptacle. A panel is selectively couplable to the plate to cover the opening.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
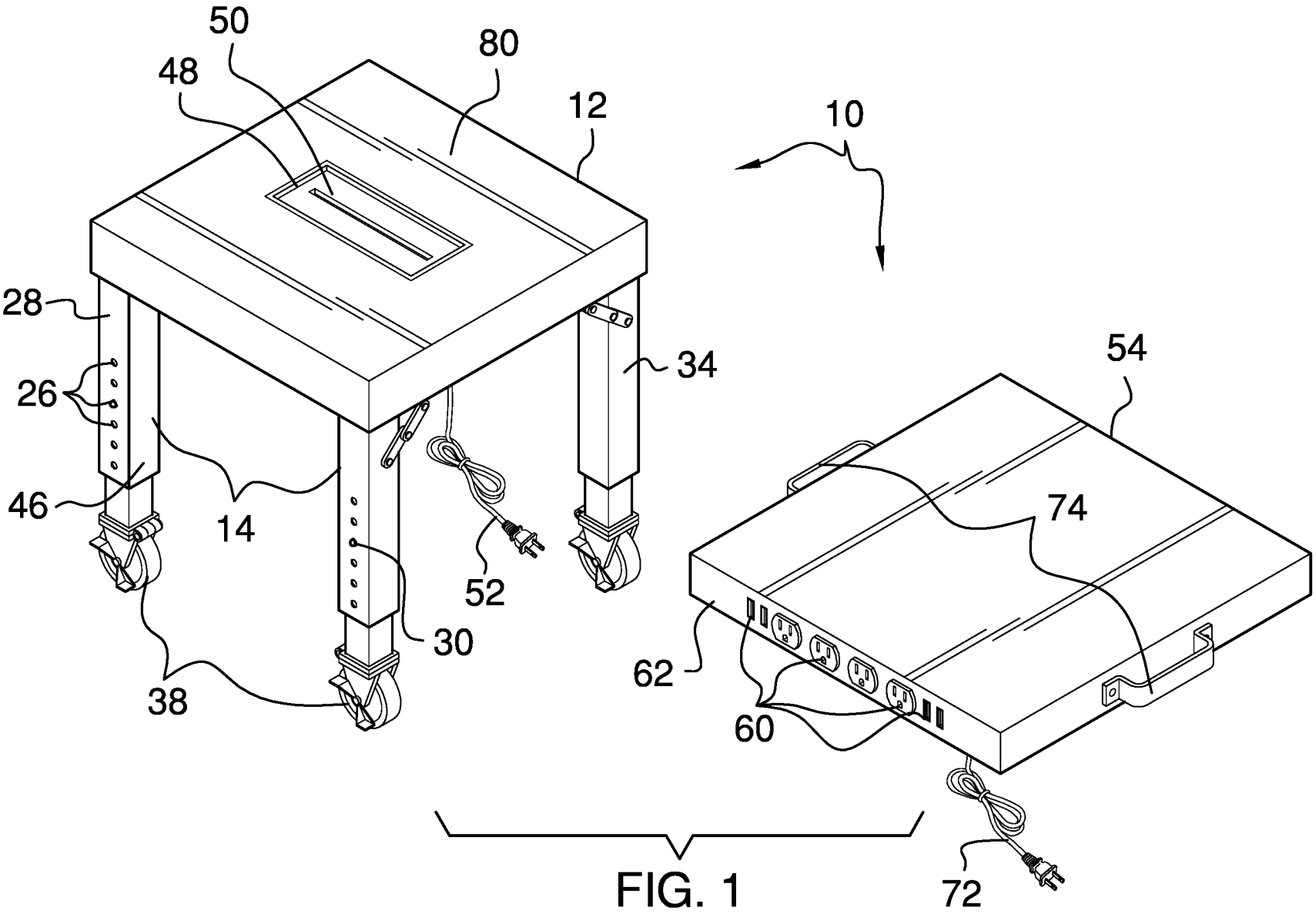
FIG. 1 is an isometric perspective view of a paper shredder support assembly according to an embodiment of the disclosure.

With reference now to the drawings, and in particular to FIGS. 1 through 5 thereof, a new support assembly embodying the principles and concepts of an embodiment of the disclosure and generally designated by the reference numeral 10 will be described.

Figure 2:
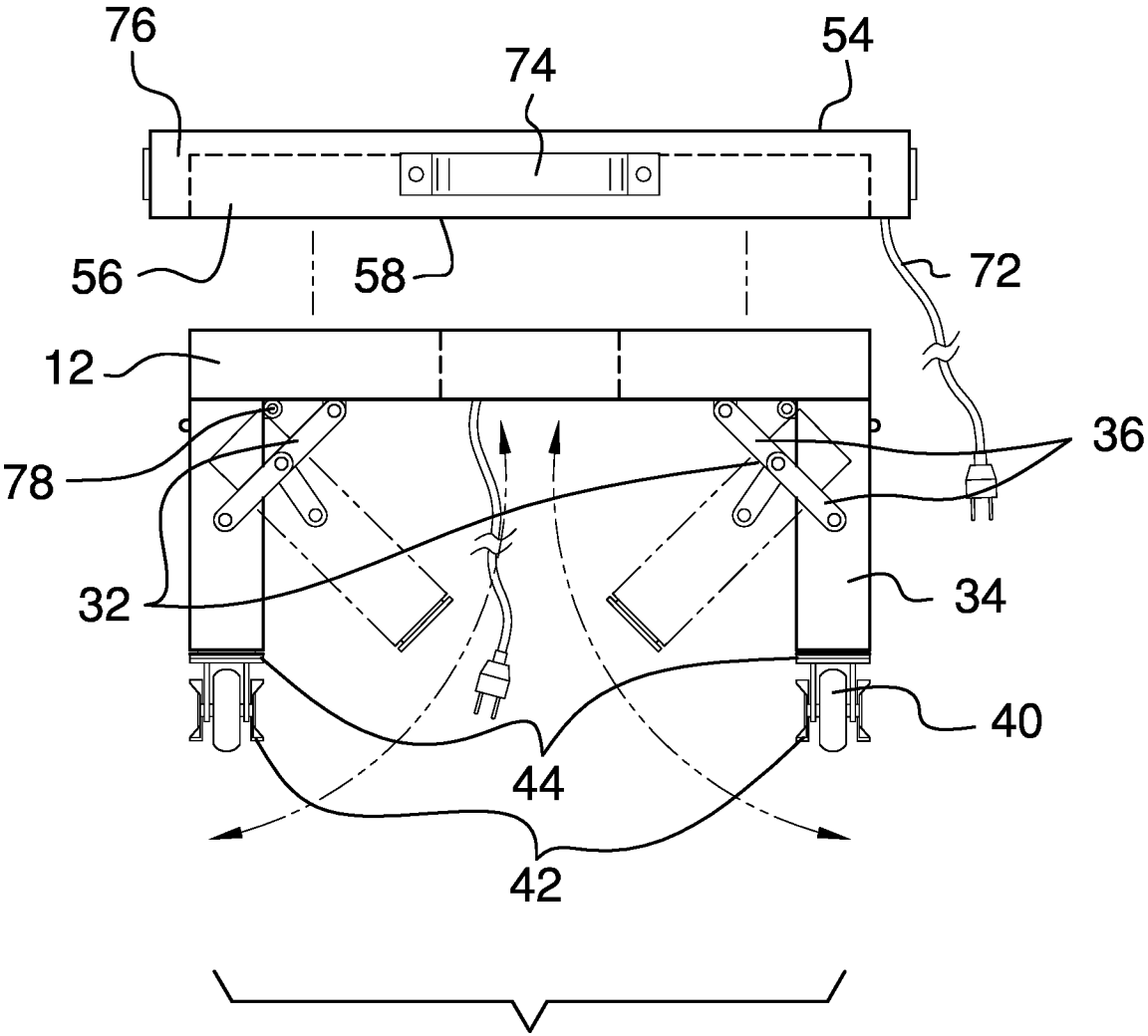
FIG. 2 is an end view of an embodiment of the disclosure.
Figure 3:
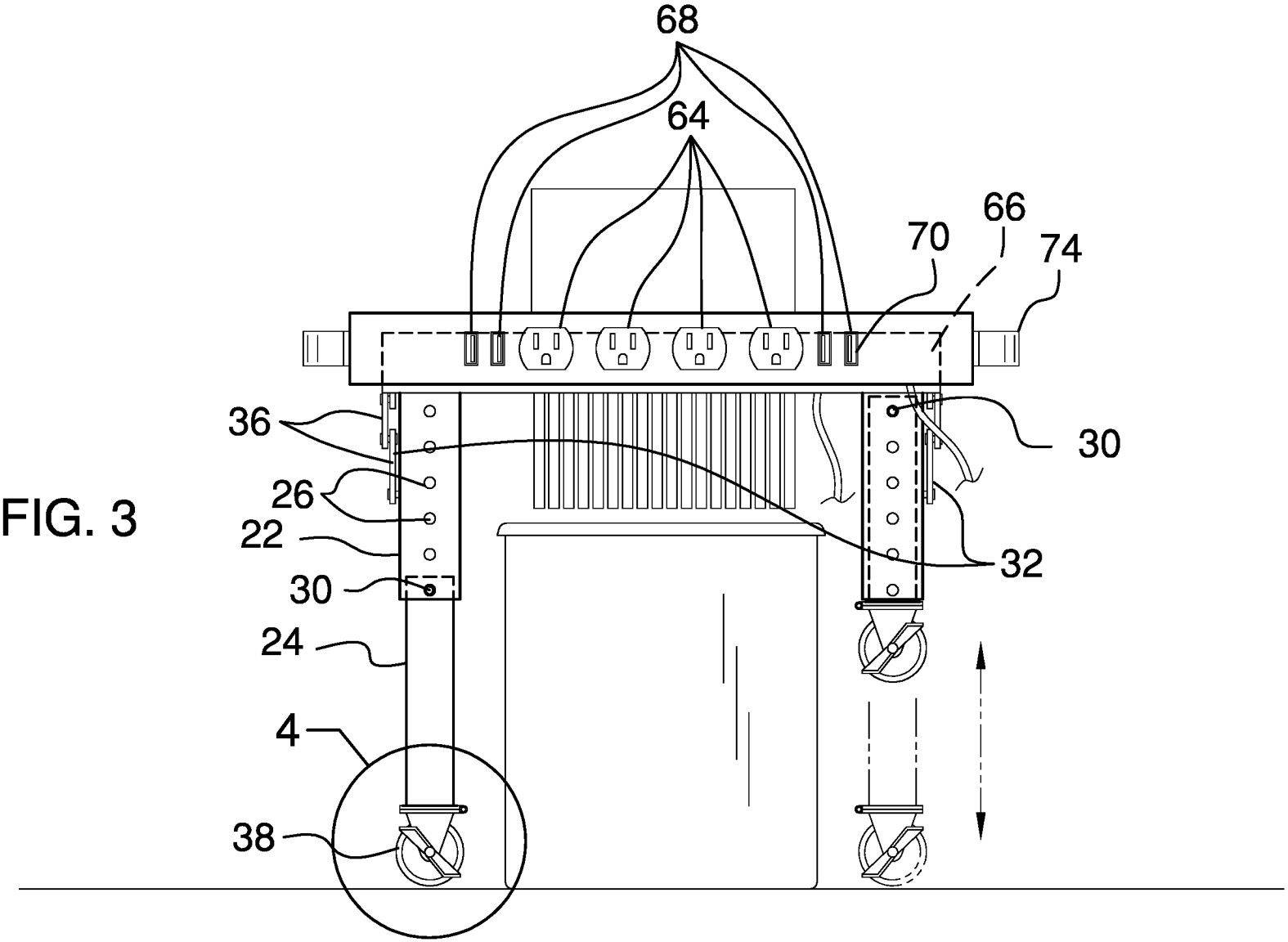
FIG. 3 is a side view of an embodiment of the disclosure.

As best illustrated in FIGS. 1 through 5, the paper shredder support assembly 10 generally comprises a plate 12, a plurality of tubes 14, and a shredder 50. The plate 12 is rectangularly shaped, squarely shaped, or the like. The tubes 14 are coupled to and extend from a bottom 16 of the plate 12. Each tube 14 comprises a plurality of nested sections 18 so that the tube 14 is selectively extensible, as shown in FIG. 3. The plurality of tubes 14 is positioned to support the plate 12 over a receptacle.

Figure 5:
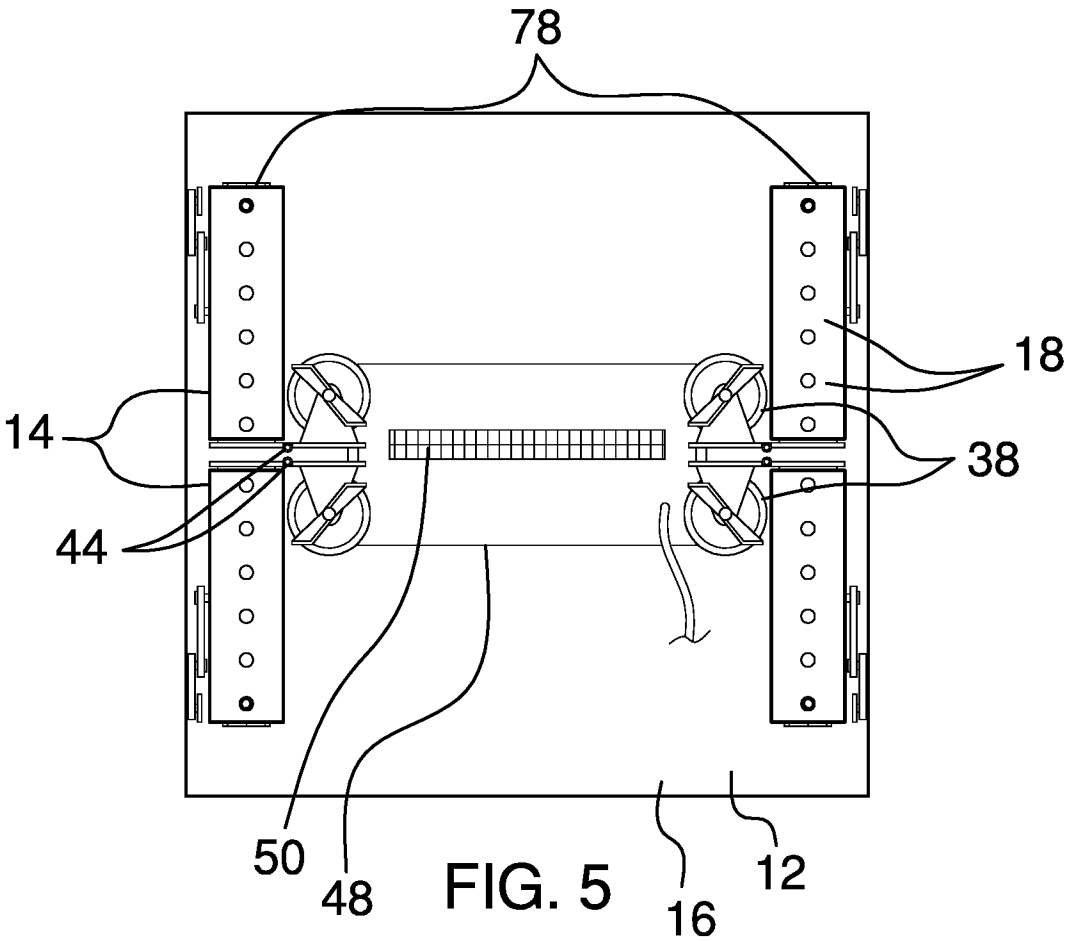
FIG. 5 is a bottom view of an embodiment of the disclosure.

The plurality of tubes 14 comprises four tubes 14 that are positioned singly at each corner 20 of the plate 12. The tubes 14 are pivotally coupled to the plate 12, as shown in FIG. 2. The tubes 14 are positioned to selectively pivot from a deployed configuration, as shown in FIG. 1, wherein the tubes 14 are perpendicular to the plate 12, to a stowed configuration as shown in FIG. 5, wherein the tubes 14 are positioned adjacent to the plate 12.

Each tube 14 comprises a plate hinge 78, an upper section 22 and a lower section 24. The plate hinge 78 is coupled to the plate 12. The upper section 22 is coupled to the plate hinge 78. The lower section 24 is selectively extensible from the upper section 22. A plurality of holes 26 is positioned in a second face 28 of the tube 14 in the upper section 22. A pin 30 is coupled to the second face 28 of the tube 14 in the lower section 24. The pin 30 is spring-loaded. The pin 30 is positioned to selectively insert into a respective hole 26 to couple the lower section 24 to the upper section 22 so that the lower section 24 is fixedly positioned relative to the upper section 22.

Each of a plurality of support hinges 32 is pivotally coupled to and extends between the plate 12 and a first face 34 of a respective tube 14, as shown in FIG. 2. Each support hinge 32 comprises a pair of segments 36. The segments 36 are pivotally coupled and selectively mutually couplable. The segments 36 are positioned to selectively mutually couple in a linear configuration to fixedly position the respective tube 14 in the deployed configuration. The segments 36 are positioned to decouple and to fold concurrently with the support hinge 32 pivoting relative to the plate 12 and the respective tube 14 to position the respective tube 14 in the stowed configuration.

Each of a plurality of rollers 38 is coupled to a respective tube 14 distal from the plate 12, as shown in FIG. 1. The plurality of rollers 38 is configured to facilitate locomotion of the plate 12 along a surface. Each roller 38 comprises a wheel 40. The wheel 40 is selectively lockable so that the wheel 40 is configured to resist locomotion of the plate 12 along the surface.

Figure 4:
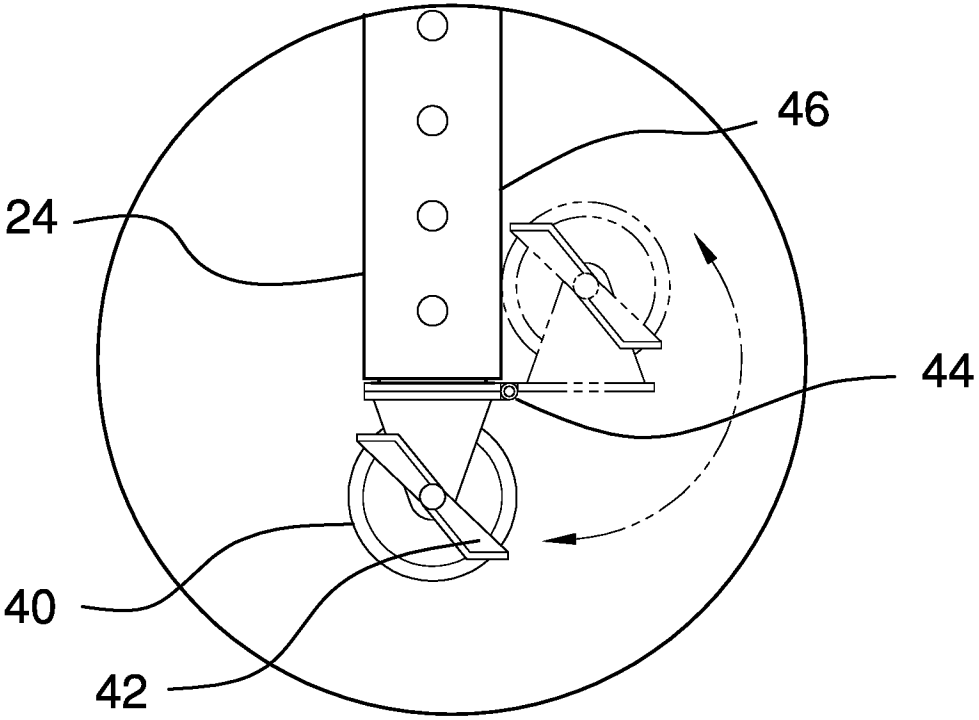
FIG. 4 is a detail view of an embodiment of the disclosure.

Each of a plurality of locks 42 is operationally coupled to a respective wheel 40, as shown in FIG. 4. The lock 42 is positioned to selectively lock the respective wheel 40 for resist locomotion of the plate 12 along the surface.

Each of a plurality of barrel hinges 44 is coupled to and extends between a third face 46 of a respective tube 14 and an associated roller 38, as shown in FIG. 4. The associated roller 38 is positioned to selectively pivot relative to the respective tube 14 to position the associated roller 38 proximate to the third face 46 of the respective tube 14.

An opening 48 is centrally positioned in the plate 12. The opening 48 is rectangularly shaped when viewed from a top 80 of the plate 12. The shredder 50 is positioned in the opening 48 and is coupled to the plate 12, as shown in FIG. 1. The shredder 50 is configured to shred items that are inserted into the shredder 50 so that shredded waste is expelled into the receptacle. A power cord 52 is coupled to and extends from the shredder 50. The power cord 52 is configured to couple the shredder 50 to a source of electrical current to power the shredder 50.

A panel 54 is selectively couplable to the plate 12 to cover the opening 48. The panel 54 is circumferentially larger than the plate 12. A recess 56 is positioned in a lower face 58 of the panel 54. The recess 56 is substantially circumferentially equivalent to the plate 12. The recess 56 is positioned to selectively insert the plate 12 to couple the panel 54 to the plate 12, as shown in FIG. 2. The recess 56 is rubber-lined so that the panel 54 is positioned to frictionally couple to the plate 12.

A plurality of connectors 60 is coupled to the panel 54, as shown in FIG. 3. Each connector 60 is configured to couple to a respective electronic device of a user. The plurality of connectors 60 is positioned on an edge 62 of the panel 54. The plurality of connectors 60 comprises a plurality of sockets 64. Each socket 64 is configured to couple to a respective electronic device of the user. The plurality of sockets 64 comprises four sockets 64. The sockets 64 are Type B.

The plurality of connectors 60 also comprises a power converter 66 and a plurality of ports 68. The power converter 66 is configured to convert alternating current to direct current. The plurality of ports 68 is operationally coupled to the power converter 66. Each port 68 is configured to couple to a respective electronic device of the user. The plurality of ports 68 comprises four ports 68. Each port 68 comprises a Universal Serial Bus port 70.

A power cable 72 is coupled to and extends from the panel 54. The power cable 72 is operationally coupled to the plurality of connectors 60. The power cable 72 is configured to couple the plurality of connectors 60 to a source of electrical current to power the respective electronic device.

A plurality of handles 74 is coupled to the panel 54. Each handle 74 is configured to be grasped in a respective hand of the user to lift the panel 54. The plurality of handles 74 comprises two handles 74 that are positioned singly on opposing ends 76 of the panel 54.

In use, the tubes 14 are pivoted from the stowed configuration to the deployed configuration and extended from the plate 12. The receptacle is positioned under the shredder 50 to capture the waste from shredding the items. When the shredder 50 is not required, the panel 54 is coupled to the plate 12 to provide a utility surface. The connectors 60 are configured to couple electronic devices of the user to the source of electrical current to power the electronic devices.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A paper shredder assembly comprising:

a plate;

a plurality of tubes coupled to and extending from a bottom of said plate, each said tube comprising a plurality of nested sections such that said tube is selectively extensible wherein said plurality of tubes is positioned for supporting said plate over a receptacle, said tubes being pivotally coupled to said plate wherein said tubes are positioned for selectively pivoting from a deployed configuration wherein said tubes are perpendicular to said plate to a stowed configuration wherein said tubes are positioned adjacent to said plate;

a plurality of support hinges, each said support hinge being pivotally coupled to and extending between said plate and a first face of a respective said tube, each said support hinge comprising a pair of segments, said segments being pivotally coupled and selectively mutually couplable wherein said segments are positioned for selectively mutually coupling in a linear configuration for fixedly positioning said respective said tube in the deployed configuration, wherein said segments are positioned for decoupling and folding concurrent with said support hinge pivoting relative to said plate and said respective said tube for positioning said respective said tube in the stowed configuration;

an opening positioned in said plate;

a shredder coupled to said plate and positioned in alignment with said opening wherein said shredder is configured for shredding items inserted into said shredder through said opening such that shredded waste is expelled into the receptacle; and a panel selectively couplable to said plate for covering said opening.

2. The assembly of claim 1, further including said plate being rectangularly shaped.

3. The assembly of claim 2, further including said plate being squarely shaped.

4. The assembly of claim 2, further including said plurality of tubes comprising four said tubes positioned singly at each corner of said plate.

5. The assembly of claim 1, further including each said tube comprising a plate hinge coupled to said plate;

an upper section coupled to said plate hinge; and a lower section selectively extensible from said upper section.

6. The assembly of claim 5, further comprising:

a plurality of holes positioned in a second face of said tube in said upper section; and a pin coupled to said second face of said tube in said lower section, said pin being spring-loaded wherein said pin is positioned for selectively inserting into a respective said hole for coupling said lower section to said upper section for fixedly positioning said lower section relative to said upper section.

7. The assembly of claim 1, further including a plurality of rollers, each said roller being coupled to a respective said tube distal from said plate wherein said plurality of rollers is configured for facilitating locomoting said plate along a surface.

8. The assembly of claim 7, further comprising:

each said roller comprising a wheel; and a plurality of locks, each said lock being operationally coupled to a respective said wheel wherein said lock is positioned for selectively locking said respective said wheel for resisting locomotion of said plate along the surface.

9. The assembly of claim 7, further including a plurality of barrel hinges, each said barrel hinge being coupled to and extending between a third face of a respective said tube and an associated said roller wherein said associated said roller is positioned for selectively pivoting relative to said respective said tube for positioning said associated said roller proximate to said third face of said respective said tube.

10. The assembly of claim 1, further including said opening being centrally positioned in said plate, said opening being rectangularly shaped when viewed from a top of said plate.

11. The assembly of claim 1, further including a power cord coupled to and extending from said shredder wherein said power cord is configured for coupling said shredder to a source of electrical current for powering said shredder.

12. The assembly of claim 1, further comprising:

said panel being circumferentially larger than said plate; and a recess positioned in a lower face of said panel, said recess being circumferentially equivalent to said plate wherein said recess is positioned for selectively inserting said plate for coupling said panel to said plate.

13. The assembly of claim 12, further including said recess being rubber-lined wherein said panel is positioned for frictionally coupling to said plate.

14. The assembly of claim 12, further comprising:

a plurality of connectors coupled to said panel wherein each said connector is configured for coupling to a respective electronic device of a user, said plurality of connectors being positioned on an edge of said panel; and a power cable coupled to and extending from said panel, said power cable being operationally coupled to said plurality of connectors wherein said power cable is configured for coupling said plurality of connectors to a source of electrical current for powering the respective electronic device.

15. The assembly of claim 12, further including a plurality of handles coupled to said panel wherein each said handle is configured for grasping in a respective hand of the user for lifting said panel, said plurality of handles comprising two said handles positioned singly on opposing ends of said panel.

16. A paper shredder assembly comprising:

a plate;

a plurality of tubes coupled to and extending from a bottom of said plate, each said tube comprising a plurality of nested sections such that said tube is selectively extensible wherein said plurality of tubes is positioned for supporting said plate over a receptacle;

an opening positioned in said plate;

a shredder coupled to said plate and positioned in alignment with said opening wherein said shredder is configured for shredding items inserted into said shredder through said opening such that shredded waste is expelled into the receptacle;

a panel selectively couplable to said plate for covering said opening, said panel being circumferentially larger than said plate;

a recess positioned in a lower face of said panel, said recess being circumferentially equivalent to said plate wherein said recess is positioned for selectively inserting said plate for coupling said panel to said plate;

a plurality of connectors coupled to said panel wherein each said connector is configured for coupling to a respective electronic device of a user, said plurality of connectors being positioned on an edge of said panel;

a power cable coupled to and extending from said panel, said power cable being operationally coupled to said plurality of connectors wherein said power cable is configured for coupling said plurality of connectors to a source of electrical current for powering the respective electronic device; and said plurality of connectors comprising:

a plurality of sockets wherein each said socket is configured for coupling to a respective electronic device of the user;

a power converter for converting alternating current to direct current; and a plurality of ports operationally coupled to said power converter wherein each said port is configured for coupling to a respective electronic device of the user.

17. The assembly of claim 16, further comprising:

said plurality of sockets comprising four said sockets, said sockets being Type B; and said plurality of ports comprising four said ports, each said port comprising a Universal Serial Bus port.

18. A paper shredder assembly comprising:

a plate, said plate being rectangularly shaped;

a plurality of tubes coupled to and extending from a bottom of said plate, each said tube comprising a plurality of nested sections such that said tube is selectively extensible wherein said plurality of tubes is positioned for supporting said plate over a receptacle, said plurality of tubes comprising four said tubes positioned singly at each corner of said plate, said tubes being pivotally coupled to said plate wherein said tubes are positioned for selectively pivoting from a deployed configuration wherein said tubes are perpendicular to said plate to a stowed configuration wherein said tubes are positioned adjacent to said plate, each said tube comprising a plate hinge coupled to said plate, an upper section coupled to said plate hinge, a lower section selectively extensible from said upper section, a plurality of holes positioned in a second face of said tube in said upper section, and a pin coupled to said second face of said tube in said lower section, said pin being spring-loaded wherein said pin is positioned for selectively inserting into a respective said hole for coupling said lower section to said upper section for fixedly positioning said lower section relative to said upper section;

a plurality of support hinges, each said support hinge being pivotally coupled to and extending between said plate and a first face of a respective said tube, each said support hinge comprising a pair of segments, said segments being pivotally coupled and selectively mutually couplable wherein said segments are positioned for selectively mutually coupling in a linear configuration for fixedly positioning said respective said tube in the deployed configuration, wherein said segments are positioned for decoupling and folding concurrent with said support hinge pivoting relative to said plate and said respective said tube for positioning said respective said tube in the stowed configuration;

a plurality of rollers, each said roller being coupled to a respective said tube distal from said plate wherein said plurality of rollers is configured for facilitating locomoting said plate along a surface, each said roller comprising a wheel, said wheel being selectively lockable wherein said wheel is configured for resisting locomotion of said plate along the surface;

a plurality of locks, each said lock being operationally coupled to a respective said wheel wherein said lock is positioned for selectively locking said respective said wheel for resisting locomotion of said plate along the surface;

a plurality of barrel hinges, each said barrel hinge being coupled to and extending between a third face of a respective said tube and an associated said roller wherein said associated said roller is positioned for selectively pivoting relative to said respective said tube for positioning said associated said roller proximate to said third face of said respective said tube;

an opening positioned in said plate, said opening being centrally positioned in said plate, said opening being rectangularly shaped when viewed from a top of said plate;

a shredder coupled to said plate and positioned in alignment with said opening wherein said shredder is configured for shredding items inserted into said shredder through said opening such that shredded waste is expelled into the receptacle;

a power cord coupled to and extending from said shredder wherein said power cord is configured for coupling said shredder to a source of electrical current for powering said shredder;

a panel selectively couplable to said plate for covering said opening, said panel being circumferentially larger than said plate;

a recess positioned in a lower face of said panel, said recess being circumferentially equivalent to said plate wherein said recess is positioned for selectively inserting said plate for coupling said panel to said plate, said recess being rubber-lined wherein said panel is positioned for frictionally coupling to said plate;

a plurality of connectors coupled to said panel wherein each said connector is configured for coupling to a respective electronic device of a user, said plurality of connectors being positioned on an edge of said panel, said plurality of connectors comprising:

a plurality of sockets wherein each said socket is configured for coupling to a respective electronic device of the user, said plurality of sockets comprising four said sockets, said sockets being Type B, a power converter for converting alternating current to direct current, and a plurality of ports operationally coupled to said power converter wherein each said port is configured for coupling to a respective electronic device of the user, said plurality of ports comprising four said ports, each said port comprising a Universal Serial Bus port;

a power cable coupled to and extending from said panel, said power cable being operationally coupled to said plurality of connectors wherein said power cable is configured for coupling said plurality of connectors to a source of electrical current for powering the respective electronic device; and a plurality of handles coupled to said panel wherein each said handle is configured for grasping in a respective hand of the user for lifting said panel, said plurality of handles comprising two said handles positioned singly on opposing ends of said panel.

* * * * *